US006412508B1

(12) United States Patent
Swann, Jr.

(10) Patent No.: US 6,412,508 B1
(45) Date of Patent: Jul. 2, 2002

(54) NATURAL GAS PIPE STORAGE FACILITY

(75) Inventor: Philip Lawton Swann, Jr., Staunton, VA (US)

(73) Assignee: Resource LLC, Staunton, VA (US)

( * ) Notice: Subject to any disclaimer, the term of this patent is extended or adjusted under 35 U.S.C. 154(b) by 0 days.

(21) Appl. No.: 09/481,433

(22) Filed: Jan. 12, 2000

(51) Int. Cl.[7] ..... F17D 1/02

(52) U.S. Cl. ..... 137/1; 137/613; 137/236.1; 405/53

(58) Field of Search ..... 137/236.1, 256, 137/266, 255, 1, 613; 405/53; 585/899

(56) References Cited

U.S. PATENT DOCUMENTS

| | | | | |
|---|---|---|---|---|
| 2,085,526 A | | 6/1937 | Diescher | |
| 2,491,013 A | | 12/1949 | Noll et al. | |
| 2,550,844 A | | 5/1951 | Meiller | |
| 2,932,170 A | | 4/1960 | Patterson et al. | |
| 2,948,294 A | | 8/1960 | Smith | |
| 3,467,118 A | | 9/1969 | Gerwick, Jr. et al. | |
| 3,950,958 A | * | 4/1976 | Loofbourow | 137/236.1 X |
| 4,729,106 A | | 3/1988 | Rush et al. | |
| 4,805,674 A | | 2/1989 | Knowlton | |
| 4,858,640 A | | 8/1989 | Kaufmann | |
| 5,207,530 A | | 5/1993 | Brooks et al. | |
| 5,333,465 A | | 8/1994 | McBride | |
| 5,431,482 A | | 7/1995 | Russo | |
| 5,458,167 A | | 10/1995 | Schultz et al. | |
| 5,461,023 A | | 10/1995 | Chang et al. | |
| 5,603,360 A | | 2/1997 | Teel | |
| 5,673,735 A | | 10/1997 | Crvelin et al. | |
| 5,803,005 A | | 9/1998 | Stenning et al. | |
| 5,810,058 A | | 9/1998 | Kountz et al. | |
| 5,813,429 A | | 9/1998 | Ohtaka et al. | |
| 5,839,383 A | | 11/1998 | Stenning et al. | |
| 6,014,995 A | * | 1/2000 | Agnew | 137/236.1 X |

OTHER PUBLICATIONS

David F. Hoffman, "Distributed Resources: The Next Wave; Regulatory Barriers Handicap New Solutions", *Strategic Planning for Energy & the New Environment*, Spring 2000, pp. 17–33, vol. 19, No. 4 Publisher: Strategic Planning for Energy & the Environment. USA.

1 CF Resources Incorporated, "Natural Gas Storage End User Interaction, Task 2", *Fossil Energy Technical Publications*, Jan. 1996, pp. 1–2 (abstract),i–viii and I–1–VII–T; USA.

James M. Thompson, "U.S. Underground Storage of Natural Gas in 1997: Existing & Proposed", *Natural Gas Monthly*; Sep. 1997; xxi–xli and Appendix F; Energy Information Administration, U.S.A.

Title 49, Subtitle B, Chapter 1, Subchapter D, Part 192 of the U.S. Code of Federal Regulations.

* cited by examiner

*Primary Examiner*—Kevin Lee
(74) *Attorney, Agent, or Firm*—Monika J. Hussell; James C. Wray

(57) ABSTRACT

An inexpensive, compact, on-site gas storage facility for the storage of natural gas uses steel pipes affixed end to end in a serpentine arrangement. The facility has a compressor, a decompressor or a pressure reducing regulator, a steel pipe storage system, and components for containing the gas in the system, controlling the delivery of gas to the system and expelling gas from the system for use or delivery of natural gas to end users. The facility includes monitors, filters or strainers, dryers, test stations and cathodic protection systems. The gas storage facility is usable in industrial, commercial, utility and residential applications.

12 Claims, 10 Drawing Sheets

NATURAL GAS PIPE STORAGE FACILITY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF INVENTION

The present invention relates to the inexpensive, compact, on-site storage of natural gas by an end user, utility, or gas supply or distribution company. More specifically, the present invention relates to the storage of natural gas by means of a facility comprising a steel pipe storage system configured and constructed as described herein which stores the gas in a compressed state. The facility of the present invention further comprises compressor and decompressor systems to compress natural gas upon injection from the utility, distribution or other supply transmission line into the steel pipe storage system and to decompress the gas upon withdrawal from the steel pipe storage system for injection into the user's facility or into a distribution pipeline for distribution and sale to others. The facility of the present invention further comprises means for containing the gas within the pipe storage system and controlling the flow of the gas to and from the facility.

Although not required elements of the present invention, optional filtering and/or drying systems may be incorporated into the facility to remove water and contaminants from the natural gas before it is stored in the steel pipe storage system. Further, the facility of the present invention may optionally include a multitude of controlling, monitoring and correcting systems, including monitoring systems measuring the humidity or water level ofthe gas prior to injection into the pipe storage system and cathodic protection systems lessening corrosion on, and test stations measuring the level of corrosion to, the steel pipes ofthe pipe storage system, all as described herein.

The present invention can be adapted for residential, commercial, industrial and utility applications, and enables end users to buy natural gas at lower prices, allows end users to have the same backup fuel supply as their primary supply, and enables utility companies and other suppliers/distributors of natural gas to store gas in a compact and inexpensive facility.

Currently, natural gas is delivered from a utility company or other supplier to an end user by means of a local utility gas distribution line, through a meter and into the end user's consumption line for immediate use by the end user. This delivery occurs at relatively low pressures, typically 5 pounds per square inch ("psi"). In return for lower rates, certain consumers (typically industrial or large commercial users) elect to receive their natural gas supplies on an "interruptible" basis, meaning that their supply of natural gas may be shut off or interrupted by the utility company or other supplier for a variety of reasons (e.g., curtailments due to excessively cold weather and insufficient line capacity). The growing demand for natural gas and limited utility line capacity could increase the frequency of interruptions for many of these consumers.

Large consumers subject to interruption of their natural gas supply typically have an alternate or backup fuel supply, such as propane fuel or fuel oil, stored on their property for use during periods of interruption. The use of a different backup fuel supply from the primary supply may make an additional facility to generate heat preferable. For example, where fuel oil is used as a backup fuel, the end user may have a backup facility comprised of a fuel oil-fired boiler or furnace. Alternatively, if the end user using fuel oil as a backup fuel does not have an additional boiler/furnace to burn the fuel oil, the burner of the boiler/furnace will need to be changed to one compatible with the use of fuel oil when the end user switches to its backup fuel supply. While end users using propane as their backup fuel supply typically use the same boiler as that used for natural gas, they may find it necessary to change the orifice through which fuel is injected into the burner of the boiler/furnace before switching the type of fuel supplied to the boiler/furnace. In many cases, the orifice must be smaller when using propane as compared to natural gas because of the higher heating units generated by burning propane. In order to avoid having to change orifices, some large industrial end users using propane fuel as a backup fuel supply have an alternate boiler/furnace to run exclusively on propane. Due to the higher heating units generated by propane or fuel oil, users of those fuels as their backup fuel supply may also have to change settings on certain manufacturing equipment.

End users using propane or fuel oil as a backup fuel supply must have a separate facility connected to the boiler/furnace to mix the propane or fuel oil with air prior to injection into the boiler/furnace. This additional facility causes some expense to the end user for maintaining the added facility and in employee training in the operations of said facility.

Per heating unit (btu), propane and fuel oil tend to be expensive in comparison to natural gas. Additionally, while the storage of propane as a backup fuel supply is typically noncontaminating, a leak of fuel oil creates hazardous conditions subject to expensive clean-up under the rules and regulations of the U.S. Environmental Protection Agency and state environmental agencies. Due to its low density, a leak or release of natural gas is not inherently contaminating and has no lasting environmental impact. Like propane, natural gas is potentially combustible if it mixes with air near an ignition source; however, the likelihood of natural gas combustion in use of the present invention is insignificant, presuming that the facility is properly manufactured, installed, operated and maintained. Your inventor prefers that the facility of the present invention be manufactured in accordance with U.S. Department of transportation ("DOT") regulations governing transmission pipeline systems. Transmission pipeline systems manufactured in accordance with those regulations have a very high safety record and correspondingly low incidence of actual combustion.

Because gas distribution companies charge less for interruptible gas service than for "firm" or non-interruptible service, the availability of natural gas as a backup fuel supply for use during periods of interruption affords end users the opportunity to achieve substantial energy cost savings while reducing the costs associated with alternative fuel supplies; further, in light of the expensive cost of propane and fuel oil in comparison to natural gas, use of natural gas as the end user's backup fuel supply would be advantageous. Moreover, due to the fluctuation in natural gas prices, it would be beneficial for end users to purchase substantial quantities of natural gas when the price is low and to store the gas until needed during periods of interruption or desired during periods when the price of natural gas is high. Finally, storage of natural gas as a backup fuel supply allows end users subject to interruption to utilize the same fuel and facilities in their backup operations.

In residential applications, users of this invention maybe able to store an entire year's worth of natural gas for their personal consumption, allowing them to purchase gas when rates are lowest.

Utility and other gas supply companies currently store natural gas in a compressed state by means of abandoned salt caverns, abandoned gas wells or other underground natural reservoirs. This storage and the processes and apparatuses associated therewith are described in U.S. Pat. No. 4,858,640. When the demand for natural gas exceeds current supply, utility companies inject a mixture of propane and air into the natural gas delivered to end users to increase the amount of gas supplied to a useable level. However, the number of heating units generated from propane-air is greater than that of natural gas, which may cause certain appliances and systems to malfunction (e.g., as regards gas stoves, the pilot light is set for a certain level of heating units specific to natural gas; excess heating units may cause the flame of the pilot light to burn higher, increasing the risk of fire). The propane-air stations used by utility companies to mix propane and air (accomplished through compressors designed for this purpose) and to inject the mixture with natural gas into transmission lines are regulated by state and federal environmental and other regulatory agencies, causing the cost of these facilities to be relatively expensive to maintain and requiring specialized professionals to operate the facilities.

Utility companies can benefit from the storage facility ofthe present invention, which allows them to compactly store additional natural gas which would complement or eliminate the need for propane storage and propane-air injection facilities. Further, utility companies can strategically locate facilities of the present invention near large users or heavily populated areas, eliminating the need to increase pipeline capacity. Unlike the preset locations of underground natural reservoirs, the facilities of the present invention may be strategically located anywhere there is suitable property to install the facility on.

Your inventor knows of no other methods to store natural gas other than in natural reservoirs, on ships for purposes of transporting natural gas and in small, tubular facilities used by suppliers of fuel for natural gas powered vehicles. The facilities for use by transporters of natural gas include those disclosed in the following U.S. Patents. U.S. Pat. No. 5,839,383 teaches the storage of compressed natural gas by means of continuous pipe wound in loops and layers and distributed within a container for purposes of transporting natural gas. U.S. Pat. No. 5,803,005 teaches the storage of compressed natural gas utilizing a plurality of gas cylinders for purposes of transporting natural gas by ship. The complicated systems in these patents not only cost more than the present invention, but are not suitable to efficiently store large quantities of natural gas on-site, available for use by an end user.

The facilities for use at vehicular fueling centers are described in the following U.S. Patents. U.S. Pat. No. 5,333,465 teaches the storage of compressed natural gas in underground tubes positioned vertically in an elongated casing. U.S. Pat. No. 5,207,530 teaches the underground storage of compressed natural gas by means of a plurality of underground storage containers. Again, the systems disclosed in these patents require many additional, and costly, components and are not suitable for on-site storage of large quantities of gas.

To be stored effectively in the storage facility ofthe present invention, it is necessary and desirable to compress the natural gas to a higher pressure (optimally 500 psi) than the standard pressure used in the end user's boiler (typically less than 10 psi). Further, regardless of pressure, the construction of the pipe storage system of the present invention should, and the preferred facilities disclosed herein is generally designed to, meet or exceed DOT Pipeline Safety Regulations, as they apply. Additional limitations may be prescribed by applicable state regulations (many states have adopted the federal standard to address safety issues on private end user pipeline systems).

BRIEF SUMMARY OF THE INVENTION

The principal objective of this invention is to provide a low-cost, non-contaminating, compact on-site storage facility to store and supply natural gas for use by end users as their main fuel supply or as their backup fuel supply during periods of interruption from the utility company or other gas provider, for financial advantage in purchasing natural gas at times when the prices for natural gas are low, and for use by utility companies and other natural gas distributors and suppliers to complement and/or reduce existing storage and complement or obviate their use of propane-air. The present invention is a storage facility which meets all of these objectives.

The storage facility of the present invention comprises a compressor unit capable of compressing natural gas to a level sufficient to satisfy the design of the facility, a pressure reduction unit suitable for decompression of the gas to a level necessary for consumption by the end user, at least one compact and continuously constructed steel pipe storage system for storage of the natural gas and means for containing the gas within the pipe storage system and controlling the flow of gas to and from the facility. The compressor unit is connected to the utility line from a utility company or other supplier of natural gas and to the steel pipe storage system, compressing and delivering gas into the pipe storage system. The pressure reduction unit is connected to the end user's consumption line (or, in the case of storage by utilities or suppliers for further distribution to end users, to the utility transmission or distribution line) and to the pipe storage system, decompressing gas stored in the pipe storage system and delivering it to the end user's consumption line or to the utility transmission or distribution line.

When necessary or desirable, optional filtering and drying systems may be added to the facility, on the utility line before the compressor, to remove water and contaminants prior to the compression and storage of the natural gas. An optional monitor may be attached to the utility line to measure the humidity of the natural gas delivered to the system. This monitor allows the operator of the facility to determine whether the natural gas should be dried prior to compression and injection into the pipe storage system. Optional test stations may be installed around portions of an underground continuous pipe storage system to monitor the corrosion of the pipe, permitting the operator of the system to remove or neutralize any source of corrosion. Optional cathodic protection systems may be installed to the underground continuous pipe storage system to reduce corrosion of the steel pipe. Other controlling, monitoring and correcting systems, advantageous embodiments and developments of the invention as regards the manufacture of the facility and the configuration for its implementation are described below in the Detailed Description of the Invention.

While the terms of this application relate generally to the storage of natural gas, it will be readily apparent to one skilled in the art upon the reading of this description that the general structure of the present facility could be used to store any compressible gas.

DETAILED DESCRIPTION OF THE INVENTION

Figure 1:
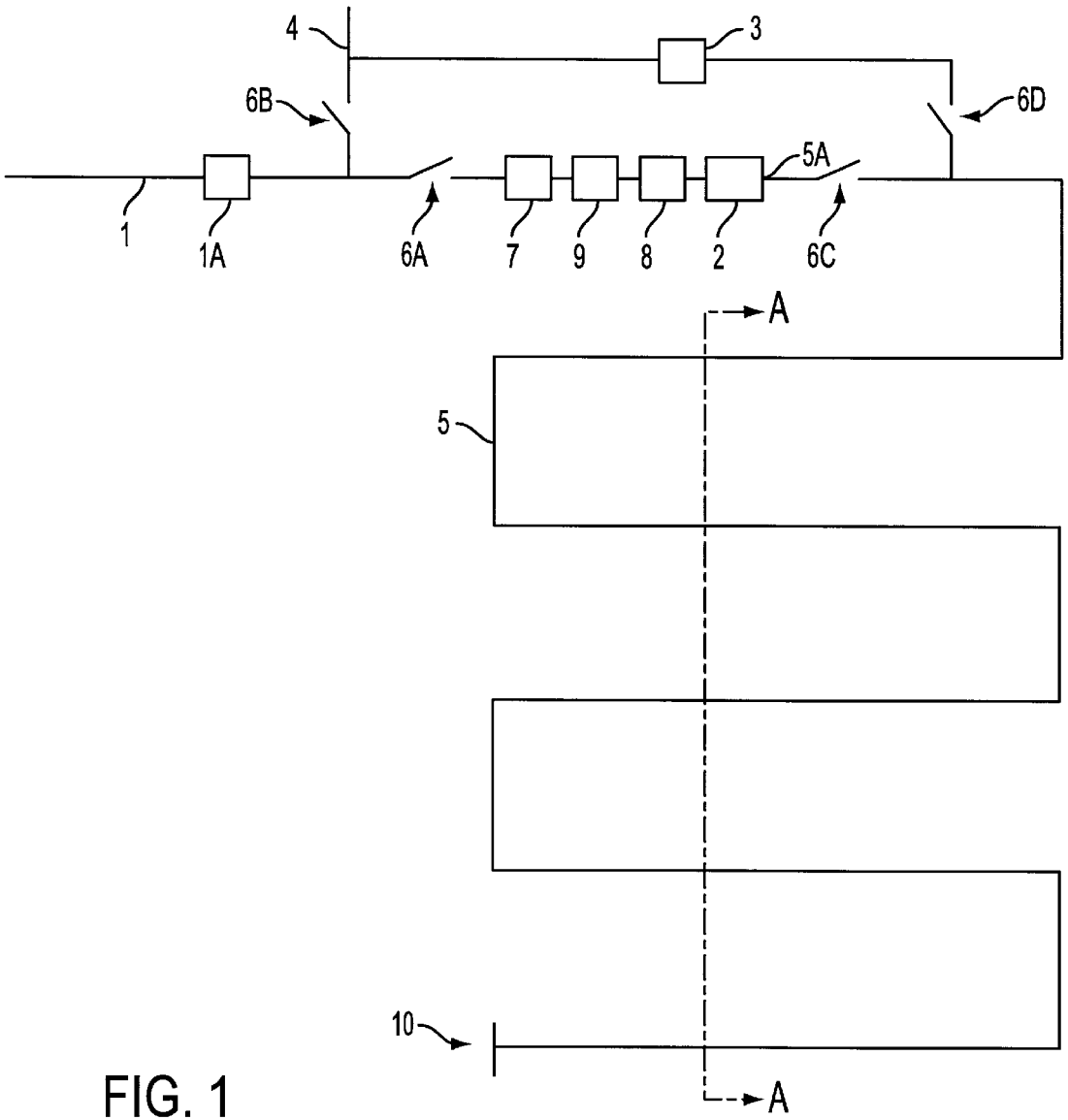
FIG. 1 shows a schematic view of one embodiment of the storage facility of the invention used in commercial or end-user applications.

FIG. 1 schematically shows an overall view of one embodiment of the facility of the invention, as applied to storage facilities for use by end users. As shown in FIG. 1, the facility of the present invention preferably comprises a compressor unit (2) connected to the utility line (1) from a utility company or other supplier of natural gas for compression of the gas to the designed pressure of the facility, a pressure reduction unit (3) connected to the end user's consumption line (4) for decompression of the gas to a level necessary for consumption by the end user, and at least one compact, continuously constructed steel pipe storage system (5) for compressed storage of natural gas, which pipe storage system (5) is connected to both the compressor unit (2) for intake of compressed gas from the utility line (1) and the pressure reduction unit (3) for expulsion of gas from the facility into the consumption line (4). The invention further comprises means for containing the stored gas within the pipe storage system (5) except when said system (5) is being filled or the gas therein is being delivered to the end user's consumption line (4), and means for controlling the delivery of gas from the utility line (1) to the pipe storage system (5) and the delivery of gas from the system (5) to the end user's consumption line (4). The utility line (1) should already be connected, through a meter (1A) and a control valve (6B), to the end user's consumption line (4) for immediate use of the natural gas delivered to the end user; the present invention is a modification to this connection, allowing natural gas to flow to the pipe storage system (5) when desired by the end user.

Figure 2:
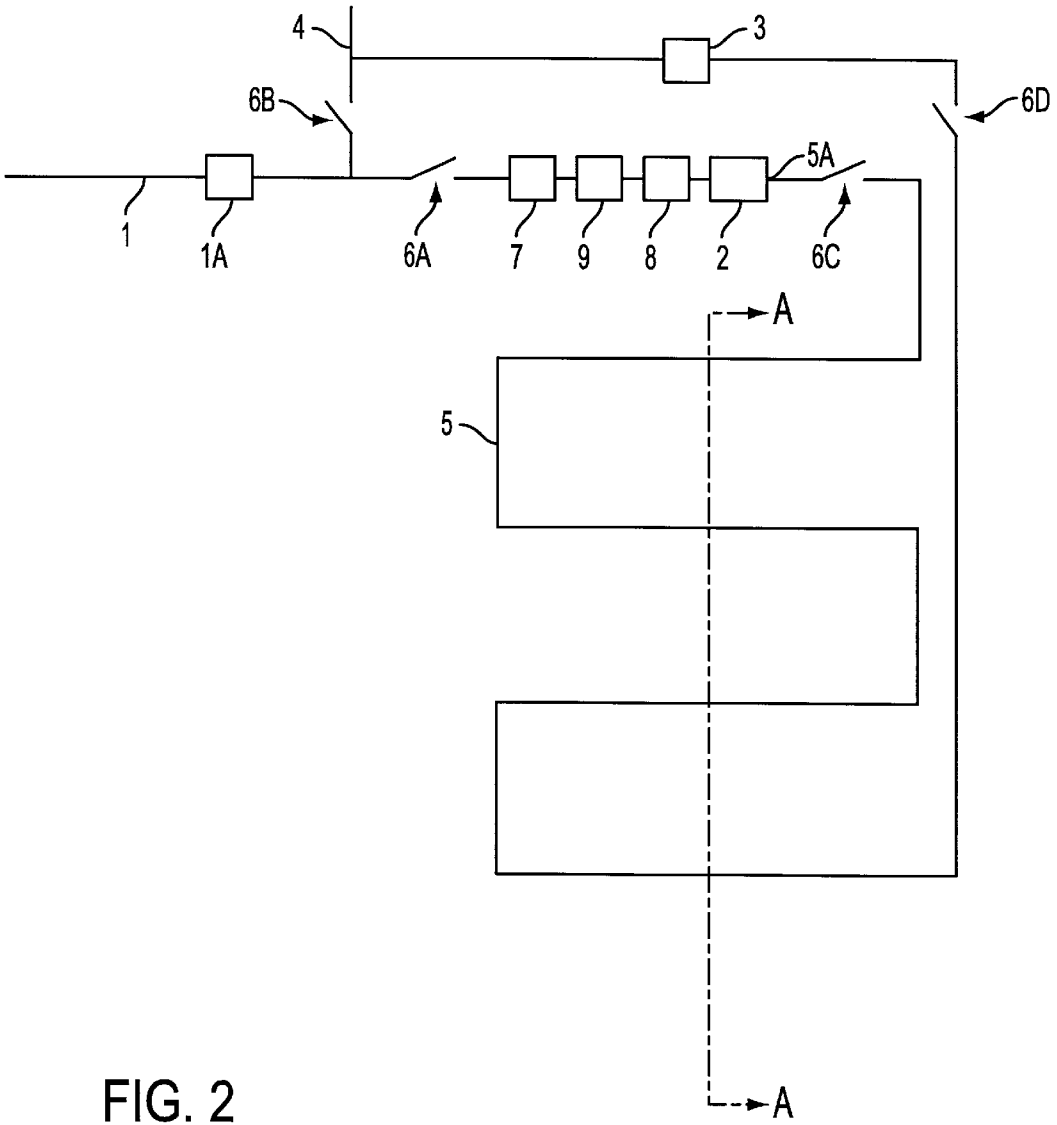
FIG. 2 shows a schematic view of another embodiment of the storage facility of the invention, used in commercial or end-user applications.
Figure 3:
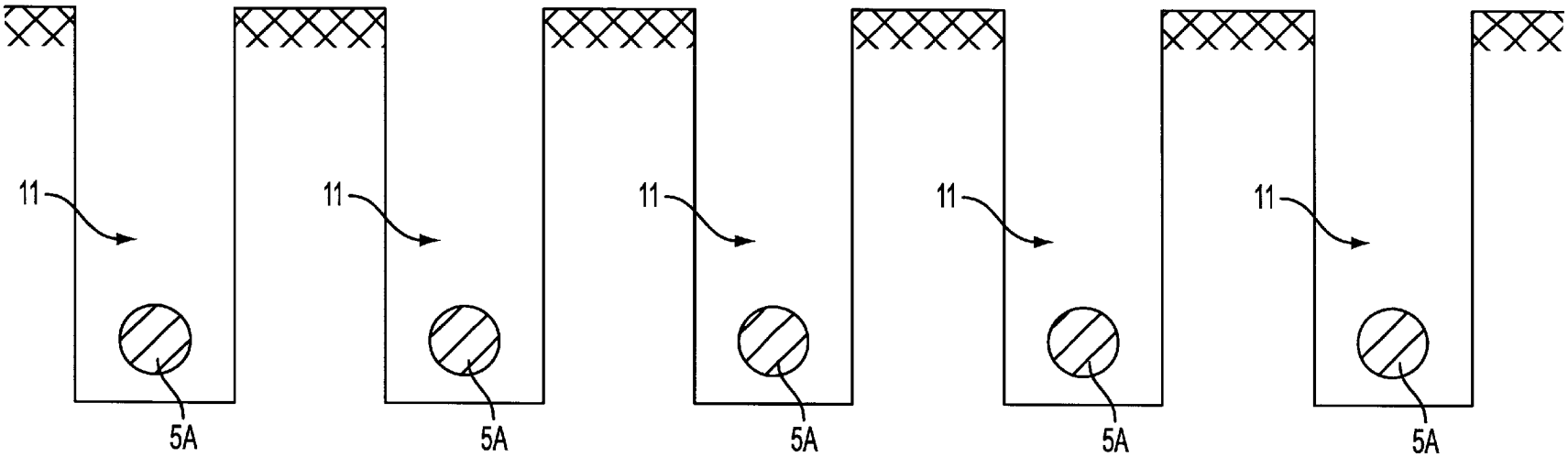
FIG. 3 shows a cross section of a portion of the embodiment of the underground pipe storage system of the invention as depicted in FIGS. 1, 1A and 2, taken along the line A—A of FIGS. 1, 1A and 2.
Figure 4:
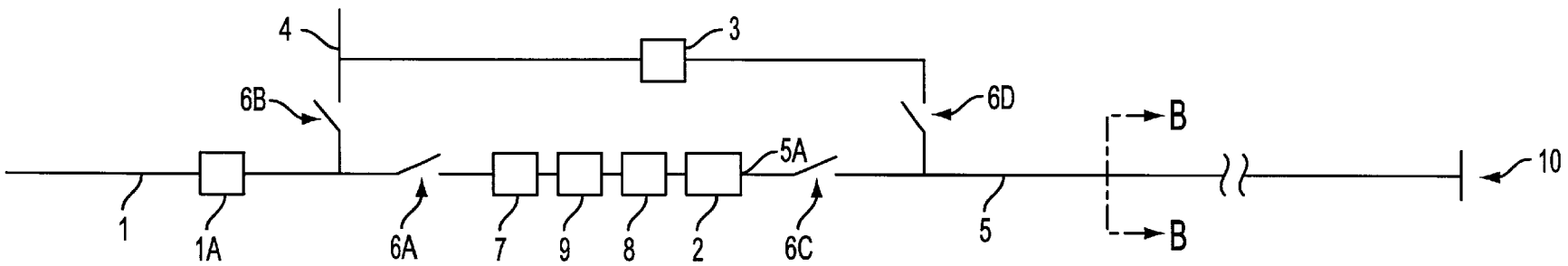
FIG. 4 shows a schematic view of another embodiment of the system of the invention, used in commercial or end-user applications.
Figure 6:
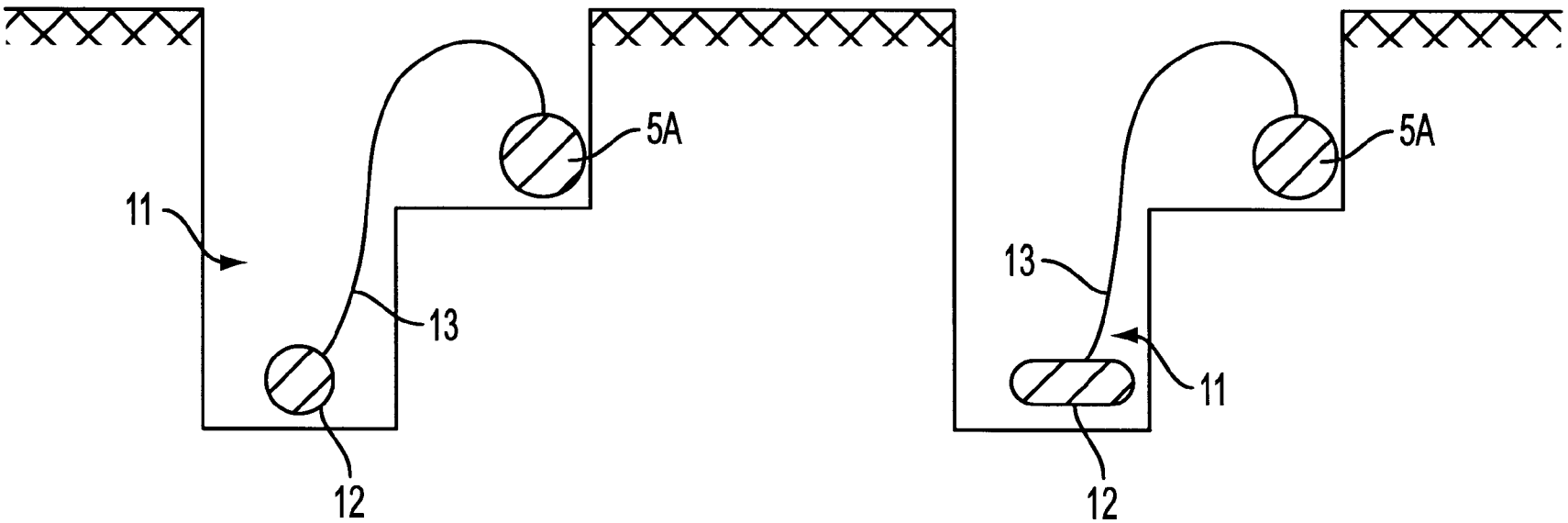
FIG. 6 shows an anode installation to diminish corrosion of the steel pipe storage system.
Figure 7:
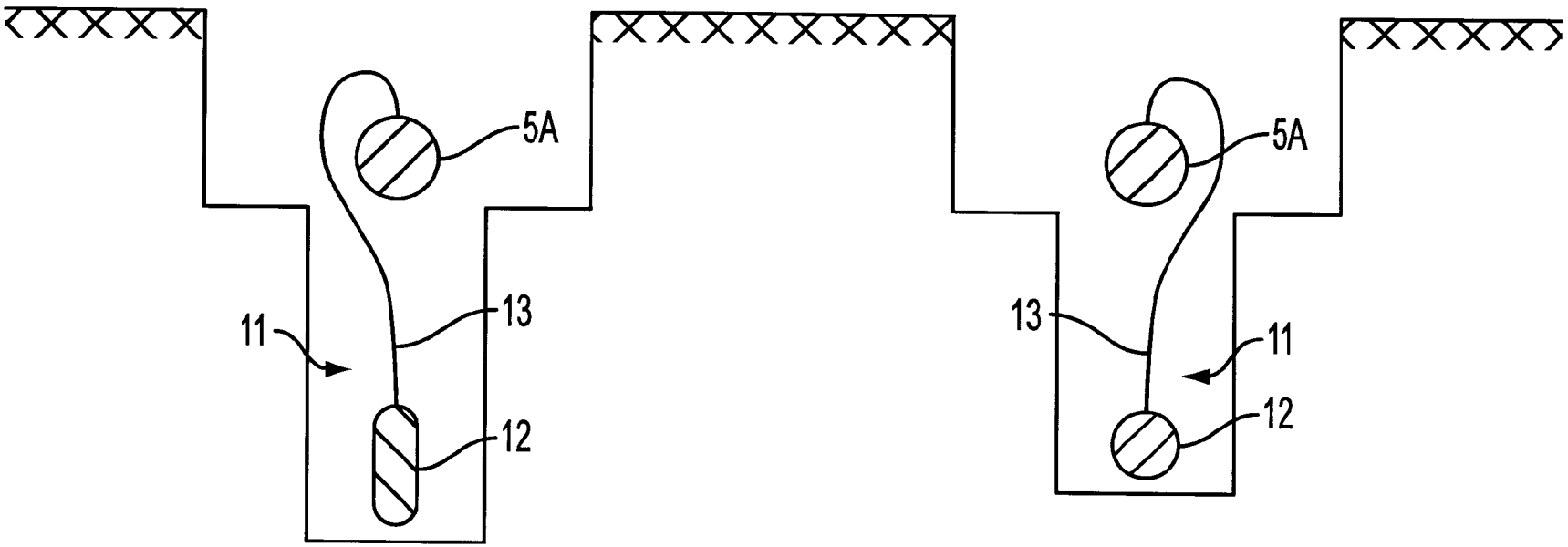
FIG. 7 shows an alternate anode installation.
Figure 8:
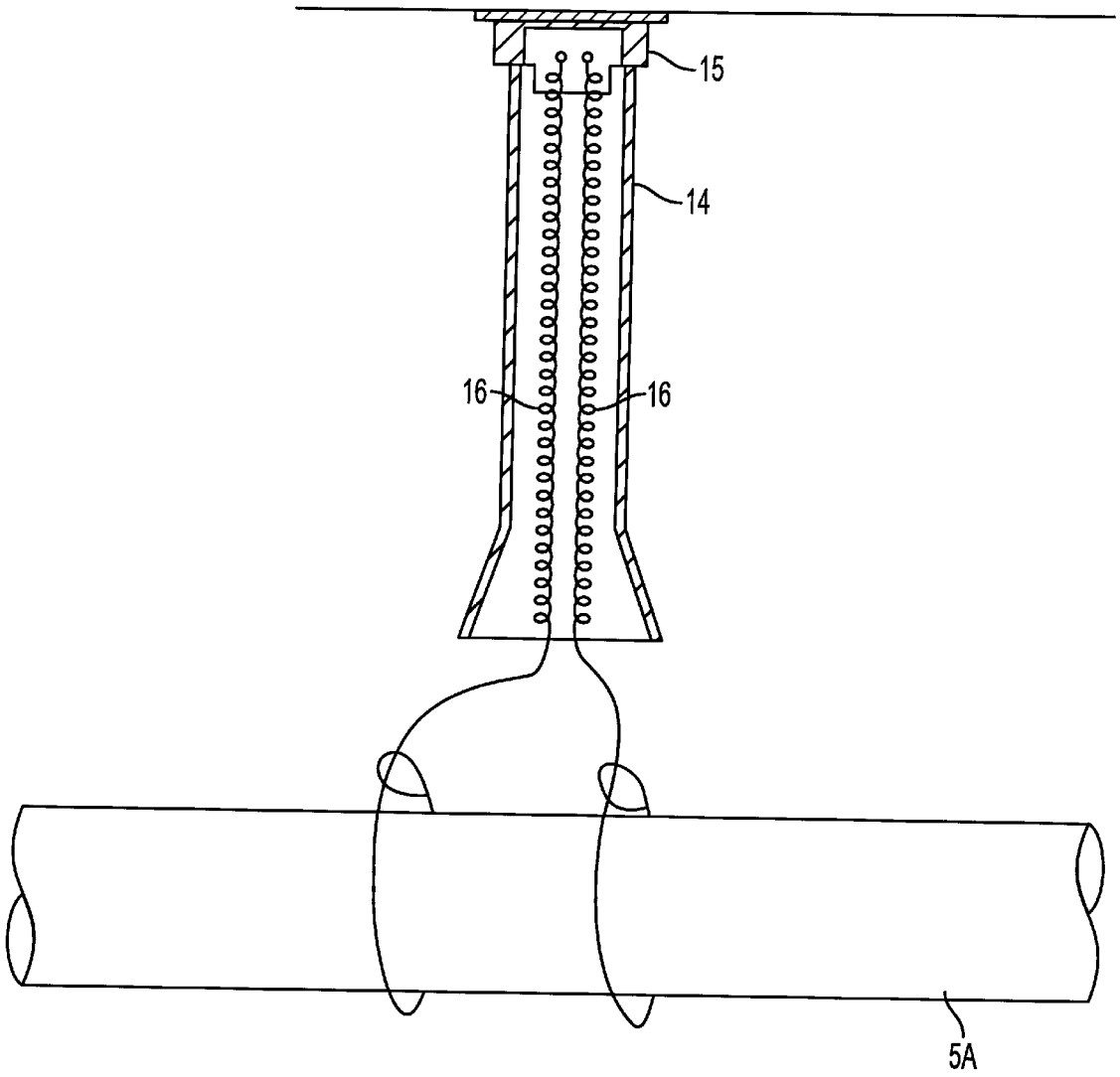
FIG. 8 shows a test station installation to detect corrosion of the steel pipe storage system.
Figure 9:
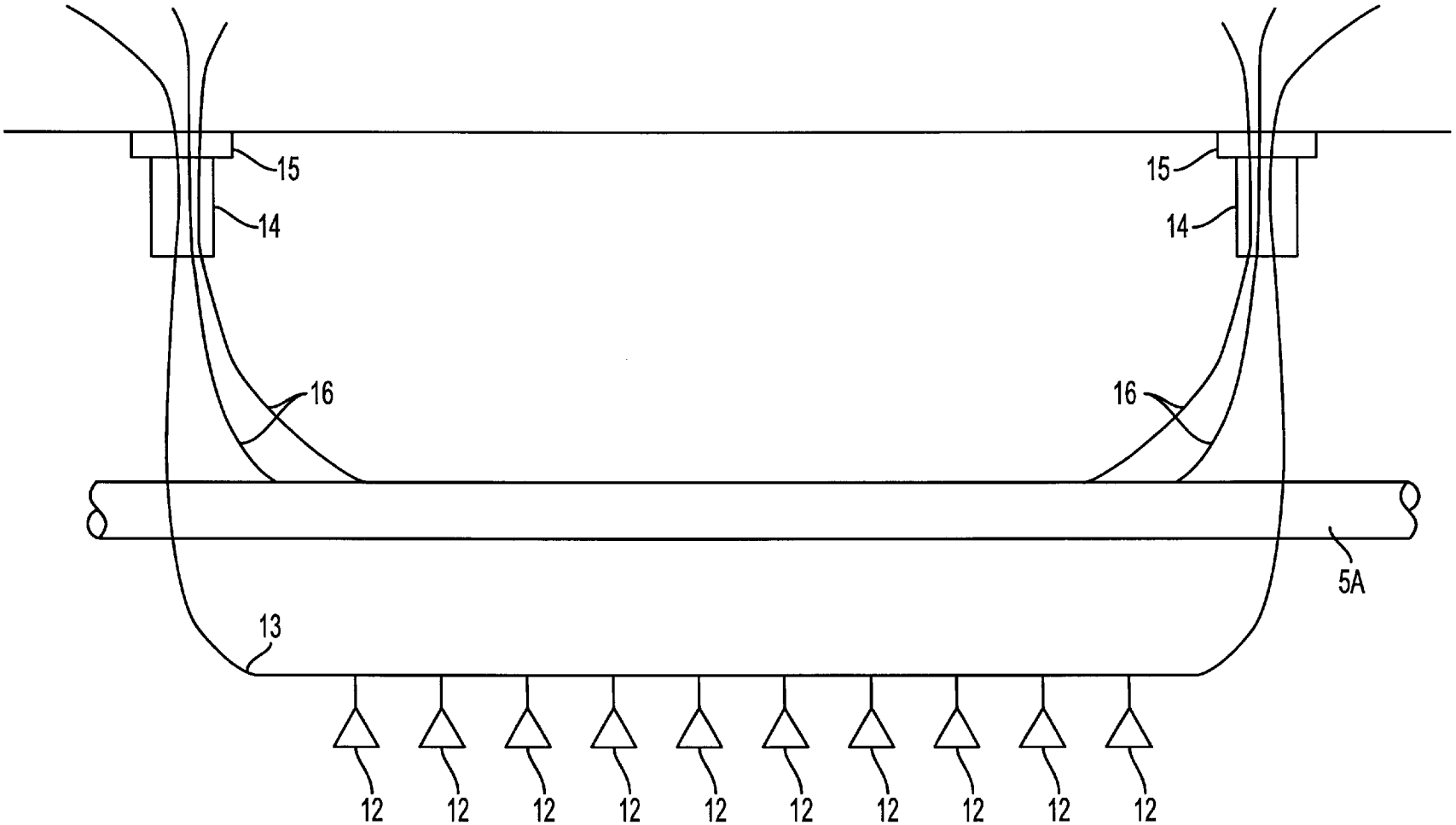
FIG. 9 shows an anode bed test station.

As depicted in FIGS. 1, 2 and 4, optional portable or fixed in-line filtering systems or strainers (7) and drying systems (8) may be installed, preferably on the utility line (1), to remove water and contaminants prior to the compression and storage of natural gas. Additionally or alternatively, optional monitors (9) may be installed on the utility line (1) to measure the humidity of the natural gas delivered to the facility in order to determine whether it would be preferable to dry the gas prior to storage in the facility, or may be installed on the pipe storage system (5) to measure the humidity of the compressed gas stored. In order to monitor the corrosion of the pipe (5A) of the pipe storage system (5), test stations may be installed on the system (as depicted in FIGS. 8 and 9 and described below); additionally, in order to protect the steel pipe (5A) of the pipe storage system (5) from corrosion, cathodic protection systems may be incorporated near and attached to the pipe storage system (5) (as depicted in FIGS. 6, 7 and 9 and described below). The preferred components of, design of, method of manufacture of, and process of the present invention follows.

Figure 1A:
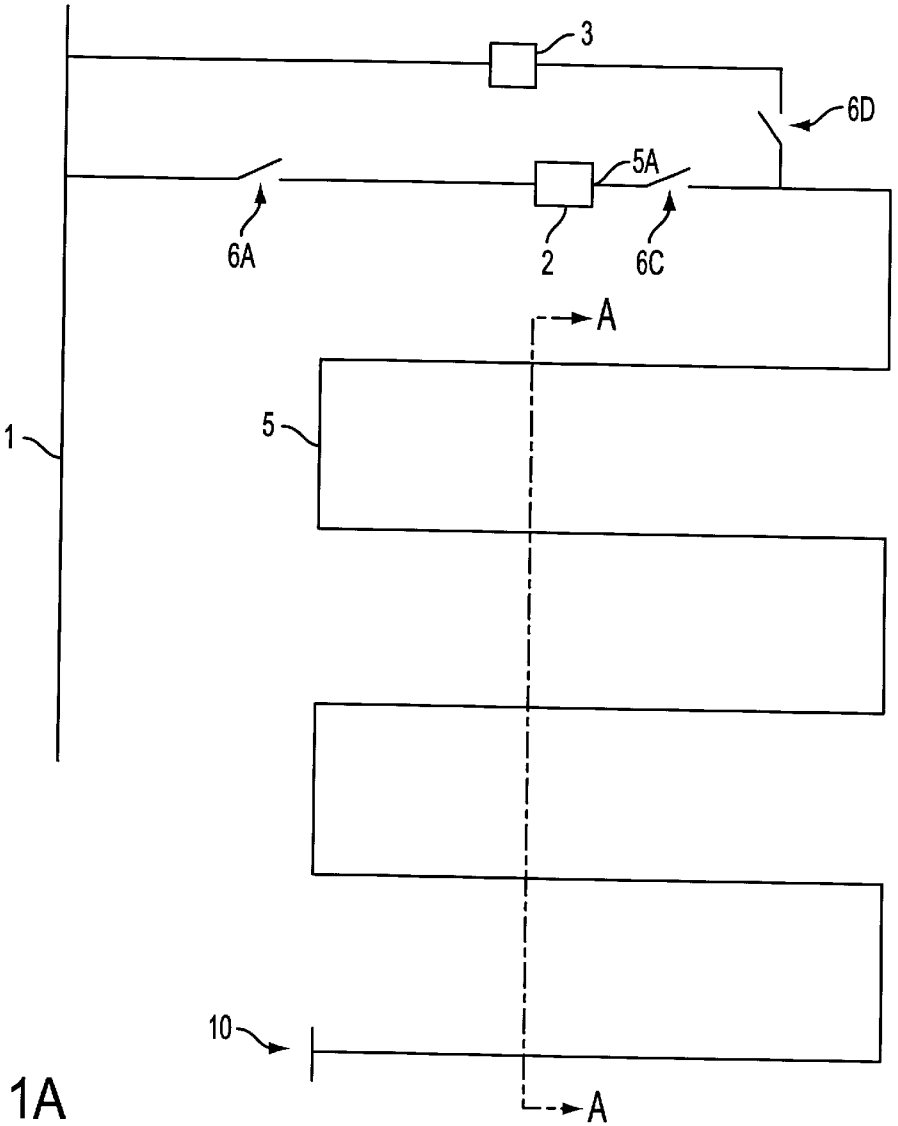
FIG. 1A shows a schematic view of another embodiment of the storage facility of the invention for use by utility companies or other suppliers of natural gas.

As depicted in FIG. 1A, the facility of the present invention may be used by utility companies and other suppliers of natural gas, where the gas is delivered to the system from the utility line (1) and is delivered from the system back to the utility line (1) for transmission to end users.

The compressor unit (2) is attached preferably above ground between and incorporated in the connection ofthe utility line (1) and the pipe storage system (5), with the suction side being attached to the utility line (1) and the pressure side of the compressor unit (2) being connected to the pipe storage system (5), causing the compression of natural gas received from the utility line (1) and delivering the same to the pipe storage system (5). In end-user applications, the suction side of the compressor unit (2) is attached after the meter (1A) on the utility line (1), as depicted in FIGS. 1, 2 and 4. Your inventor prefers to use standard, reciprocating-type compressors, although other types of compressors suitable for compressing natural gas as known to those skilled in the art may be used. Since natural gas compressors vary in the maximum level of output pressure, the compressor unit (2) used in the facility should be one sufficient to compress the natural gas to the designed maximum pressure of the storage facility. When the facility is designed so as to require infrequent injection of natural gas, or injection only during certain times of the year, it may be more economical for the end user to attach a portable compressor unit (2) only when injecting natural gas into the system. When removing a portable compressor (2), the exposed end (5A) of the pipe storage system (5) should be sealed by welding an end cap thereto. When the end user chooses to refill the facility, the end cap can be removed by cutting it off and the portable compressor can be reconnected to the utility line (1) and the pipe storage system (5). Alternatively, a portable compressor (2) may be connected to the utility line (1) and the pipe storage system (5) by means of a flange; when the compressor is removed, a plate system may be bolted on the flange to seal off the utility line (1) and the pipe storage system (5). Examples of commercially available and suitable compressors for use in the present invention include Bauer High and Medium Pressure Natural Gas Compressors. The end user will set the compressor to a certain maximum level of pressure in accordance with the system design.

The pressure reduction unit (3) comprises a decompression unit or pressure reducing regulator attached, preferably above ground, and incorporated in the connection of the pipe storage system (5) and the user's consumption line (4), causing the decompression and delivery of the gas from the pipe storage system (5) to the operating pressure of the end user's facility as depicted in FIGS. 1, 2 and 4. In utility storage applications, as shown in FIG. 1A, the pressure reduction unit (3) is attached and incorporated in the connection of the pipe storage system (5) and the utility or transmission line (1) for delivery to end users. Your inventor prefers to use pressure reducing regulators for the decompression of natural gas, although other types of decompressors or regulators known for decompressing natural gas may be used, as are well known to one skilled in the art. The choice of a decompressor regulator should be specific to the design of the system as a whole; with sufficient pressure ranges in both the outlet (consumption line (4) or utility/transmission line (1)) and inlet (pipe storage system (5)) pressures. The pressure reducing unit should be set to the pressure level required by the end user's burner or furnace in end user applications, or the level of the utility's transmission line, in utility applications. Examples of commercially available and suitable pressure reducing regulators include Fisher Rosemount's line of natural gas Pressure Reducing Regulators, including its Type 399A Pressure Reducing Regulator. The use of more than one pressure reduction units (3) may be advantageous or even necessary in colder climates where the regulator may freeze or otherwise malfunction when cold gas at a low pressure passes through and is decompressed by the pressure reduction unit; alternatively, under such circumstances the manufacturer may install a line heater or other heating device to the exposed or above-ground portion ofthe pipe storage system (5) to warm the gas during colder temperatures.

As depicted in FIGS. 1, 1A, 2 and 4, the means for containing stored gas within the pipe storage system (5) and controlling the flow of gas to and from the facility preferably comprises at least three valves, an injection valve (6A), a containment valve (6C), and a delivery valve (6D), located respectively on the utility line (1), on the suction side of the compressor unit, and on the pipe storage system (5), on the pressure side of each of the compressor unit (2) and the pressure reduction unit (3), although it would be appreciated by one skilled in the art that other valves and means of containing and controlling the flow of natural gas could be used. Specifically, as depicted in FIGS. 1, 1A, 2 and 4, injection valve (6A) controls the flow of gas from the utility line (1) into the facility of the present invention; the end user will turn this valve on when filling the facility with natural gas, and off when the delivery is complete (especially when a portable compressor is removed from the facility, to prevent uncontrolled expulsion of natural gas into the environment). Containment valve (6C) controls the flow of gas from the compressor unit (2) to the pipe storage system (5), and should be turned on only when filling the facility with natural gas, and at all other times should be turned off. Containment valve (6C) is particularly important when using a portable compressor unit (2) to preclude the release of gas from the pipe storage system (5) when removing the compressor (2). Finally, delivery valve (6D) controls the flow of gas from the pipe storage system (5) into the consumption line (4) (or, in the case of utility applications, into the utility line (1)), and should be turned on when stored natural gas is being used by the end user, and should be turned off at all other times. Control valve (6B) controls the flow of gas from the utility line (1) to the end user's consumption line (4), and should be turned off when gas from the facility is being delivered to the end user's consumption line (4). Control valve (6B) may be open to permit gas to flow both to the consumption line (4) and to the pipe storage system (5), or if gas is not presently needed by the enduser, the control valve (6B) may be closed, resulting in delivery of natural gas to the pipe storage system (5) only (presuming injection valve (6A) is open). This control valve (6B) may already be installed on the end user's consumption line (4) prior to the installation of the facility of the present invention. The valves (6A), (6B), (6C) and (6D) can be gate or butterfly mechanical valves, or any other valve capable of installation on the utility line (1), the consumption line (4), and the pipe storage system (5). The valves can be controlled either manually or electronically, as is well known to one skilled in the art.

Your inventor prefers the pipe storage system (5) to be substantially underground to improve the safety and cost ofthe system and aesthetics of the property; however, he appreciates that the pipe storage system (5) may be located at ground level or even above ground. The pipe storage system (5) comprises various compatible shapes and lengths of steel pipe (5A), as necessary to meet the design necessitated by the client's facilities and property, including anticipated usage requirements and available acreage. Although any diameter pipe (5A) may be used, the diameter of the pipe used preferably ranges from 1" to 48". The pipe (5A) used should have sufficient wall thickness to safely hold the maximum pressure of gas which the system is designed to hold and to withstand anticipated external pressures and loads that will be imposed on the pipe (5A) after installation. Where no unusual pressures or loads are anticipated, the wall thickness ofthe pipe (5A) should preferably result in a hoop stress of less than 6,000 psi; it would be appreciated by one skilled in the art that a lower hoop stress would be necessary where external pressures or loads bear on any portion of the pipe storage system (5). While above-ground storage of the pipe storage system (5) is an acceptable, although not preferred, method of implementing the current invention, due to its exposure to human error (e.g. vehicles) and severe weather, the pipe used in an above ground facility should have a greater strength and corresponding lower hoop stress than that necessary for an underground system, causing greater expense. Further, the surrounding earth supports the pipe of underground pipe storage systems (5), requiring a lower pipe strength and allowing a correspondingly higher hoop stress.

The pipes (5A) of the pipe storage system (5) should be coated to prevent corrosion. Commercially available and suitable types of coating for the facility include Scotchkote™ 206N, Fusion Bonded Epoxy Coating, manufactured by 3M, Extruded Polyethylene coating manufactured by Dura-Bon Coating Inc, and Mar X, Product No. 7-2501, manufactured by Nap-Gard, all of which are generally resistant to corrosive soils, hydrocarbons, harsh chemicals and seawater.

The units of coated steel pipe (5A) are joined end to end by welding procedures standard in the industry. All welds in the pipe storage system (5) should be x-ray or radiographically inspected or otherwise nondestructively tested to verify that the welds effectively connect the pipes (5A) together and will prevent natural gas from leaking from any portion of the pipe storage system (5).

As depicted in FIG. 2, the pipe storage system (5) may be continuous, beginning at the compressor unit (2) and ending at the pressure reduction unit (3), or it may be noncontinuous, as depicted in FIG. 1, terminating at the end of the pipe (10) on its own, with connections for the compressor unit (2) and pressure reduction unit (3) at the opposite end ofthe pipe storage system (5). Where the pipe storage system (5) is noncontinuous, the exposed end of pipe (10) is sealed by welding a disk-shaped weld end cap thereto.

The layout of the pipe storage system (5) may vary from facility to facility, with the designer of the system designing a pipe layout to suit the storage needs of the end user and the acreage and layout of the property. Preferred examples of effective underground storage of the pipe include stacking the pipe in a ditch line or excavated trench (see FIGS. 4 and 5) or using a radiator type design (see FIGS. 1, 1A, 2 and 3), or a combination of these methods. When stacking the pipe, fill material will need to be placed between and around the layers of pipe (5A), with sufficient fill material between lateral pipe lines (5A) to reduce the level of stress on the coating of the pipe to a negligible amount.

Pipe diameter and length and desired compression of the natural gas in the facility will vary depending on the end user's storage requirements and space limitations. It would be obvious to one skilled in the art that varying the diameter and length of the pipe (5A) used in the pipe storage system (5), and varying the designed pressure of compressed natural gas in the facility, will vary maximum gas volume capacity. In calculating the amount of pipe needed for storage systems, your inventor uses the Ideal Gas Law (PV=nRT), where P is pressure measured in atmospheres, V is volume measured in liters, n is the molecular weight of the total natural gas to be stored, measured in moles, R is the gas constant (0.0821 for natural gas) and T is the absolute temperature (K) of the gas. Assuming that gas is delivered to the system at 5 psi and that it is delivered to, and will be stored in, the pipe storage system (5) underground at a standard temperature of 52° F., the following examples demonstrate the amount of cubic feet necessary to store varying amounts of gas at different pressures, first using the Ideal Gas Law to calculate the total molecular weight of the gas to be stored (measured at 5 psi) and then using the Ideal Gas Law to determine the cubic feet necessary to store the gas at the proposed storage pressure:

Example I

| Eg. | P (atm) | R | T (K) | Volume of Gas (measured at 5 psig) (ft$^3$) | (L) | Molecular weight of Volume (Moles) |
|---|---|---|---|---|---|---|
| 1 | 1.34 | 0.0821 | 284 | 750,000 | 21,225,000 | 1,220,141.3 |
| 2 | 1.34 | 0.0821 | 284 | 2,500,000 | 70,750,000 | 4,067,137.6 |
| 3 | 1.34 | 0.0821 | 284 | 125,000 | 3,537,500 | 203,356.9 |
| 4 | 1.34 | 0.0821 | 284 | 7,000,000 | 198,100,000 | 11,387,985.3 |

Example II

| Eg. | Molecular weight of Volume (Moles) | Desired Pressure (psi) | (atm) | Volume Necessary (L) | (ft$^3$) |
|---|---|---|---|---|---|
| 1 | 1,220,141.3 | 500 | 35.04 | 811,984.4 | 28,692.03 |
| 2 | 4,067,137.6 | 700 | 48.65 | 1,949,191.26 | 68,876.02 |
| 3 | 203,356.9 | 1,000 | 69.07 | 68,644.98 | 2,425.62 |
| 4 | 11,387,985.3 | 750 | 52.06 | 5,100,876.17 | 180,242.97 |

From these calculations, the designer of the facility can choose a pipe diameter and determine the length of pipe necessary to manufacture the pipe storage system. The following are examples for such calculations, using each of the examples above:

Example III

| Eg. | Volume Necessary (ft$^3$) | Pipe Diameter (in) | Area of Pipe Face (ft$^2$) | Length of Pipe Needed (ft) |
|---|---|---|---|---|
| 1A | 28,692.03 | 24 | 3.14 | 9,131.77 |
| 1B | 28,692.03 | 36 | 7.07 | 4,058.57 |
| 2A | 68,876.02 | 24 | 3.14 | 21,921.07 |
| 2B | 68,876.02 | 36 | 7.07 | 9,742.70 |
| 3A | 2,425.62 | 24 | 3.14 | 772.00 |
| 3B | 2,425.62 | 36 | 7.07 | 343.11 |
| 4A | 180,242.97 | 24 | 3.14 | 57,365.68 |
| 4B | 180,242.97 | 36 | 7.07 | 25,495.86 |

Finally, once the necessary length of the pipe is determine, the layout of the pipe storage system (5) can be designed as exemplified below, using each of the above examples:

Example IV

| | Single Pipe Layout: | | Stacked Pipe Layout: | | |
|---|---|---|---|---|---|
| Eg. | No. of Rows | Approximate Length of Rows (ft) | No. of Rows | No. of Pipes Stacked | Approximate Length of Rows (ft) |
| 1A | 5 | 1,826 | 3 | 2 | 1,522 |
| 1B | 6 | 676 | 4 | 6 | 169 |
| 2A | 3 | 7,307 | 2 | 3 | 3,654 |
| 2B | 7 | 1,392 | 7 | 5 | 278 |
| 3A | 2 | 386 | 2 | 3 | 129 |
| 3B | 4 | 86 | 1 | 2 | 172 |
| 4A | 15 | 3,824 | 4 | 2 | 7,171 |
| 4B | 4 | 6,374 | 5 | 3 | 1,700 |

All calculations made in the tables of the examples above do not consider the rounding off of numbers. Further, they do not take into account the thickness of the pipe; the diameter being measured from the outside of the pipe walls. It would be obvious to one skilled in the art that when actually designing a system, the thickness of the pipe walls must be considered, thereby requiring additional length of pipe in the system of the present invention.

While not required, various optional components may be temporarily or permanently affixed to the facility of the present invention to improve the overall performance of the facility. Specifically, dryer systems (8), monitors (9) and in-line filters (7) may be used in the facility to respectively dry the gas, monitor the humidity of the gas, and remove contaminating materials before gas is compressed and stored. The need for or desirability of these components should be determined by the manufacturer following an evaluation of the quality of gas to be delivered to the storage facility. Any of these components may be temporarily or permanently installed on the utility line (1).

While certain qualities of natural gas at the delivery pressure may not need to be dried, it should be known by one skilled in the art that the compression of natural gas causes moisture to accumulate in greater amounts per cubic foot which, depending on the designed pressure of the storage facility and the resulting humidity of the compressed gas per cubic foot, may require that the gas be dried prior to injection into the pipe storage system (5). The dryer systems (8) remove water vapor from compressed natural gas, and are installed at the low pressure suction side of the compressor unit (1), as depicted in FIG. 1. Dryers (8) are desirable but not necessary unless, in your inventors preferred method and consistent with the natural gas delivery industry standard, the compressed natural gas contains more than seven pounds of water per million cubic feet of compressed gas. Suitable commercially available dryers include "xebec" Type STVCNG and STCNG desiccant dryer systems. Certain compressor units (2), such as the Bauer Compressors described above, have dryers contained within the compressor unit (2) and are suitable for use in the present invention in lieu of or in addition to a dryer system (8).

In certain applications where gas to be delivered to the system has a high humidity level or where the end user desires additional protection from the natural corrosion of pipes (5A) caused by humidity and contaminants, it may be beneficial to use pipe (5A) that is internally (epoxy) coated to prevent corrosion. Suitable commercially available coating for the interior of steel pipes include Endcore® 747 Amine-Cured Epoxy Coating, which provides a tough, adherent friction- and corrosion-resistant surface. The internal coating of pipes, however, adds to the expense of the system and is only necessary under extreme conditions.

Since the humidity level of natural gas may change from delivery to delivery, a monitor (9) can be temporarily or permanently installed on the utility line (1) before the dryer system, if any, to monitor the amount of water in the natural gas delivered to the facility. Utility companies use a hygrometer to measure the level of water contained in natural gas, and such a device would be suitable in the facility ofthe present invention. Commercially available and suitable in-line hygrometers and moisture analyzers include those manufactured by Panametrics, specifically Panametrics' System 280 Microprocessor Based Portable Natural Gas Moisture Analyzer and its Moisture Monitor Series 3. The moisture probe of the monitor (9) is installed into the utility line (1) by means of a small pipe or weld let, where the probe is screwed into the pipe when gas is delivered to the system. If desirable, the monitor may be removed after the facility is filled.

In-line filters (7) remove dirt, rust, and general debris resulting from corrosion of the utility line (1). Although not necessary, it is desirable to install the in-line filter (7) before the dryer system (8) and/or the monitor (9), if any, to prevent the corrosive particles from causing wear and tear to those components. Commercially available and suitable in-line filters include those manufactured by American Meter Company, specifically its KleanLine™ filters.

In addition to the foregoing optional components, optional pressure sensing and transducing means (e.g. gauges) may be installed in the pipe storage system (5) to determine the pressure in the system at any given time or to monitor the pressure in the system over a period of time. Further, sacrificial anodes or other cathodic protection systems which prevent corrosion to the pipes (5A) of the pipe storage system (5) caused by native pipe, soil potentials and stray sources of current, and/or test stations which monitor the corrosion of said pipes (5A), may be installed with the pipe storage system (5) if desired by the end user. Suitable cathodic protection systems include the use of sacrificial anodes or a rectifier system. As depicted in FIGS. 6 and 7, sacrificial anode systems which provide cathodic protection are installed by placing a sacrificial anode (12) a short distance away from the pipe (5A) of the pipe storage system (5), and hooking it up to the pipe (5A) by means of an anode lead wire (13), where the anode lead wire (13) is attached to the pipe using a cadweld connection. FIGS. 6 and 7 show variations on the placement of the anode (12) in relation to the pipe (5A), although other placements are acceptable. It is well known to those skilled in the art that in order to be effective, several cathodic protection systems should be installed along rows of pipe (5A), preferably within 75" feet of one another.

Suitable test stations used to test the corrosion of pipe (5A) of the pipe storage system (5) include curb box test stations, as depicted in FIG. 8. Specifically, curb box test stations comprise a plastic curb box or collective sleeve (14), having a lid (15), and having housed within said sleeve (14) two AWG #2 TW insulated copper, coiled wires (16), through the length of the sleeve (14) and extending, uncoiled, below the sleeve (14). The extended portion of said wires (16) are half hitched loosely around the pipe (5A), and then thermite welded to the pipe (5A). The wires (16) can be accessed above ground for purposes of measuring the level of corrosion ofthe pipes (5A) by removing the lid (15) and by connecting said wires (16) to a pipe to soil potential indicator. As the various pieces of pipe (5A) may corrode unevenly, it is well known to one skilled in the art that several test stations should be installed where variations in soil content and contamination exist around the system.

Test stations and cathodic protection systems described above may be combined, as depicted in FIG. 9, showing two test stations and several sacrificial anodes. The anode lead wire (13) of the cathodic protection system portion of the combined system extends from the anodes, through the collective sleeve (14) and to ground surface and can be accessed by removing the lid (15). When corrosion to the pipe (5A) is detected, the anode system can be connected to the pipe by connecting the anode lead wire (13) to the end of one of the coiled wires (16) at the top of the collective sleeve (14), thereby engaging the cathodic protection system.

The optional components set forth in this description are not intended to limit the end user's installation of controlling, monitoring or correcting systems, and it would be well known to one skilled in the art that additional components may be added to the system to monitor and control the flow of natural gas and correcting corrosive conditions. Further, as understood by those skilled in the art in light of the present invention, the particular types of pipes, control valves, compressor and decompressor units, pressure sensing and transducing means and other optional or required components of the facility of the present invention will vary depending on the end-user requirements, site conditions, quality of natural gas to be delivered to the system, and other variables such as federal and state regulations governing the storage or transmission of natural gas, customer preferences and insurance requirements.

Figure 5:
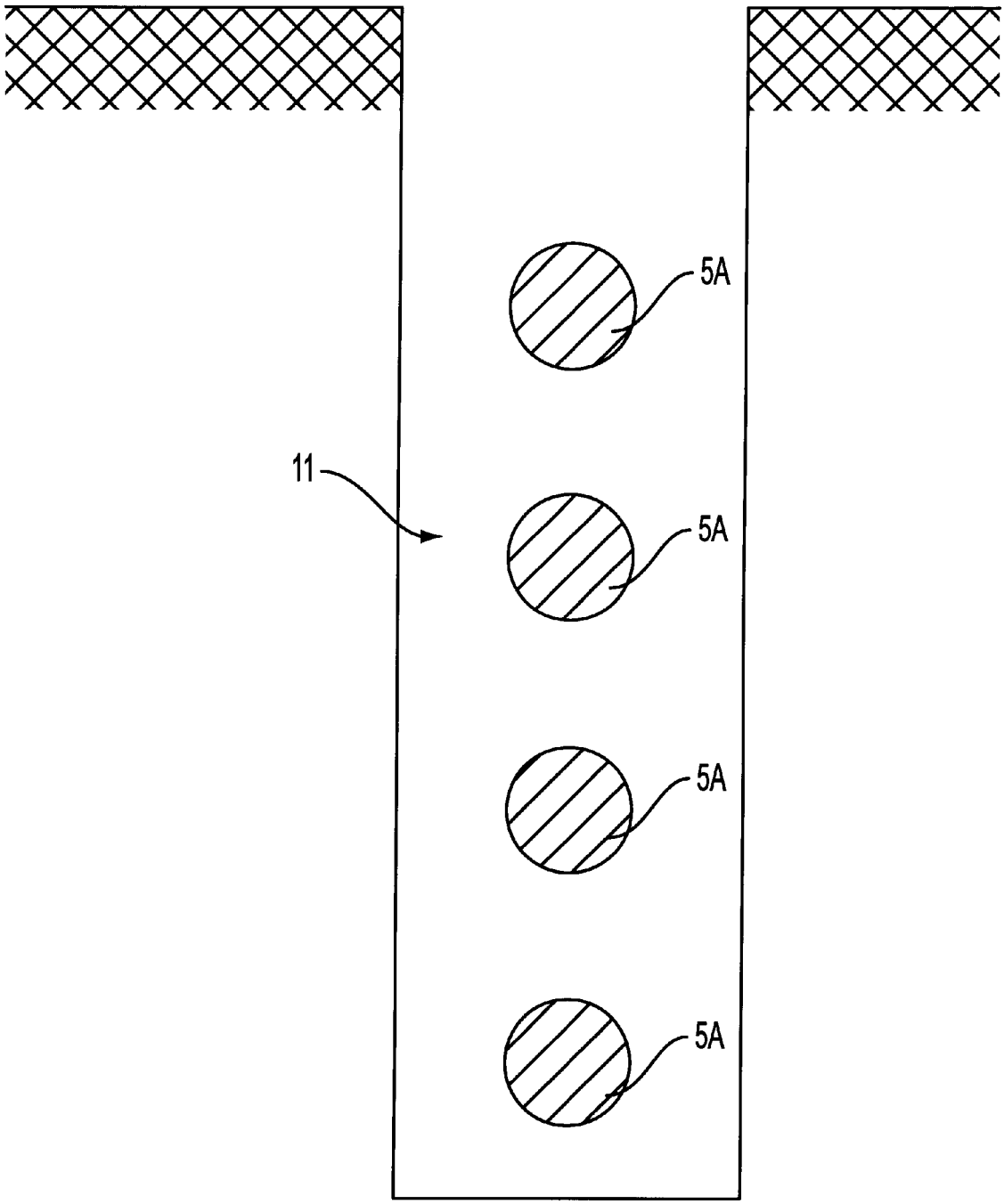
FIG. 5 shows a cross section of a portion of the embodiment of the underground pipe storage system of the invention as depicted in FIG. 4, taken long the line B—B of FIG. 4.

The pipe storage system (5) of the present invention is installed using conventional excavation or trenching equipment and pipe laying techniques, preferably underground and pursuant to U.S. DOT Regulations and other governing laws, rules and regulations. While the depth of the pipe trench (11) will vary depending on the proximity of the facility to residential or heavily populated areas, and depending on the type of soil in which the pipe storage system (5) is stored, your inventor prefers under normal conditions to bury the pipe under at least 36" of soil. Where the pipe is stacked for compact storage as depicted in FIG. 5, the trench will preferably be sufficient to have the pipe (5A) closest to the surface under at least 36" of soil, and to have sufficient fill between the layers of pipe to reduce the risk of damage to the coating of the pipe. Where the design of the pipe storage system (5) includes a radiator design (as depicted in FIGS. 1, 1A, 2 and 3), additional care must be taken to give sufficient distance between the trenches (11) so as not to cause corrosion by damaging the coating of the pipe. Further, the designer of the system should be aware that installing any portion of the system close to another underground structure may result in damage to the pipe (5A).

Prior to lowering of pipe storage system (5) into the trench (11), all welded joints should to be x-rayed, covered with a coating of a type consistent with and compatible to the pipe coating used on the pipe storage system (5). Also, the entire storage facility should be inspected visually or with suitable instruments to detect defects or holidays in pipe coating. Any defects detected should be corrected prior to installation ofthe system. The constructed pipe storage system (5) is then lowered into the trench using conventional pipe laying techniques so as not to damage the coating or stress the pipe. Any pipe coating defects visible after the storage facility is placed in the ground should be repaired at this phase of construction.

After the pipe storage system (5) is lowered in the trench(es) (11), cathodic protection systems and/or test stations, if desired, are installed around the pipe and in the trench. Backfill and compaction operations with select backfill material (no rocks, stones or debris that could damage the pipe coating) can now be undertaken to bury the pipe storage system (5) and the cathodic protection systems and/or test stations, if any, taking care to maintain the curb box just below grade level.

Once the pipe storage system (5) is in place, welded connections are made from the pipe storage system (5) to the compressor unit (2) and pressure reduction unit (3) and all applicable valves or other means of controlling and containing the natural gas can be installed. These welds should be x-rayed, and coating should be applied to these connections. Any optional components to be installed on the utility line (1) can be installed at any time. Barrier posts and fencing can be placed on the surface of an underground pipe storage system (5) or around an above-ground pipe storage system to prevent damage and limit access to the above-ground portions of the pipe storage system.

Once all connections are made, pressure testing of the system may begin. The test medium used for testing the pressure ofthe system should be water, air or nitrogen gas, although any other appropriate test medium maybe used. Preferably, nitrogen gas is injected into the pipe storage facility to a measure of at least 1.5 times the maximum allowable designed operating pressure of the pipe storage facility. The pressure is preferably held for at least 1hour, and in cases where the hoop stress of the steel pipe (5A) exceeds 30% of the minimum yield strength of the pipe (5A) used, preferably held for at least 8 hours, to check for leaks. The test pressure and test time are recorded on a chart by a recording gage or similar instrument. In the event that the pressure tests are not successful, the manufacturer must determine the location of the leaks causing the pressure tests to fail and either weld or coat the sources of the leaks, as applicable, repeating the test until successful. After successful completion of pressure tests, the test medium is released and injection of natural gas is ready to begin. Natural gas is slowly injected, without compression, into the storage facility. Instrument readings are taken using a combustible gas indicator ("CGI") to ensure that the air or nitrogen is "purged" from the pipe storage facility and a combustible gas mixture does not exist so that only natural gas will be in the system. Once it is confirmed that no test medium remains in the system by means of the CGI readings or otherwise, compression of the natural gas can begin.

When the desired compression is reached, compression is stopped and the gas is stored until needed, closing valves (6A) and (6C). When natural gas is needed, the valve (6D) is opened at the pressure reduction unit (3), the unit is turned on and gas flows through the pressure reduction unit (3), lowering the pressure of the natural gas injected into the end user's consumption line (4) to the desired pressure. Gas will continue to be supplied until the pressure level in the pipe storage system (5) has dropped to the value of the pressure level of the end user's consumption line (4).

A possible site for the pipe storage facility is in or around the storm water retention ponds that are required at most new construction sites and exist on many current sites; these areas are generally removed from activities of the site and are adapted for fencing and other desirable barriers.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

I claim:

1. A facility for the compressed storage of natural gas comprising:

a compact on-site end user storage facility to store compressed natural gas and supply the natural gas for use by end users as their main fuel supply or as their backup fuel supply during periods of interruption from a utility company or other gas provider, the on-site end user storage facility being attached to a meter on a utility line and to a consumption line, further comprising:

(A) means for compressing natural gas;

(B) means for decompressing natural gas;

(C) one or more fully enclosed steel pipe storage systems for the compressed storage of natural gas; and (D) means for containing the gas within said steel pipe storage systems, and controlling the flow to and from said systems, said means for compressing natural gas being connected through a meter to the utility line, said means for decompressing natural gas being connected to the consumption line, and said steel pipe storage system(s) being connected to both the means for compressing natural gas and the means for decompressing natural gas.

2. The facility claimed in claim 1, wherein the means for compressing natural gas comprises a compressor and the means for decompressing natural gas comprises a decompressor.

3. The facility claimed in claim 1, wherein the means for compressing natural gas comprises a compressor and the means for decompressing natural gas comprises a pressure reducing regulator.

4. The facility claimed in claim 1, where the means for containing the gas within said steel pipe storage systems, and controlling the flow to and from said systems, comprise an injection valve, a containment valve and a delivery valve, where (A) said injection valve is incorporated in said utility line at the suction side of the means for compressing natural gas, controlling the flow of gas from the utility line to said means for compressing natural gas;

(B) said containment valve is incorporated in said pipe storage system at the pressure side of said means for compressing natural gas, controlling the flow of gas from the means for compressing natural gas to the pipe storage system, and (C) said delivery valve is incorporated in said pipe storage system at the pressure side of said means for decompressing natural gas, controlling the flow of gas from the system to the consumption line.

5. The facility claimed in claim 1, wherein the steel pipe storage system comprises several compatible pieces of steel pipe, affixed end to end, forming an enclosed circuit of pipes, with one end of said circuit connected to the means for compressing natural gas and the other end connected to the means for decompressing natural gas.

6. The facility claimed in claim 1, wherein the steel pipe storage system comprises several compatible pieces of steel pipe, affixed end to end, with one end of said system sealed and the other end of said system connected to both the means for compressing and decompressing natural gas.

7. The facility claimed in claims 1, 2, 3, 4, 5 or 6, wherein the steel pipe storage system is constructed in a radiator design, with portions of the pipe storage system laterally parallel to one another.

8. The facility claimed in claims 1, 2, 3, 4, 5 or 6, wherein the steel pipe storage system is constructed in a stacked design, with portions of said pipe storage system stacked on top of one another.

9. A fuel gas process comprising providing a compact on-site end user storage facility to store and supply natural gas for use by end users as their main fuel supply or as their backup fuel supply during periods of interruption from a utility company or other gas provider, delivering gas to and storing gas under high pressure in a steel pipe storage facility, constructed by affixing several compatible pieces of steel pipe, affixed end to end, forming an enclosed circuit of pipes, and feeding the stored gas from said steel pipe storage facility into a low pressure line for consumption, further comprising delivering gas from a utility line through a meter; (A) the storing further comprising a first stage of compressing the delivered gas and injecting the compressed gas into the steel pipe storage facility, and (B) the feeding further comprising a second stage of decompressing the stored gas from the said steel pipe storage facility and flowing the decompressed gas into a consumption line; and repeating said first and second stages.

10. A process for delivering gas, comprising providing a compact on-site end user storage facility to store and supply natural gas for use by end users as their main fuel supply or as their backup fuel supply during periods of interruption from a utility company or other gas provider, storing gas under high pressure in, and expelling gas from a steel pipe storage facility, further comprising a first stage where gas is received from a utility line through a meter, compressed and injected into said steel pipe, affixed end to end, forming an enclosed circuit of pipes; and a second stage where gas in the said storage facility is decompressed and injected into a comsumption line; said first and second stages are repeated, further comprising a third stage, where said facility is periodically tested for corrosion.

11. A fuel gas method comprising providing a compact on-site end user storage facility to store and supply natural gas for use by end users as their main fuel supply or as their backup fuel supply during periods of interruption from a utility company or other gas provider, filling a steel pipe gas storage facility with compressed gas from a utility line, and delivering said gas to a consumption line, (a) wherein the filling further comprises transferring for storage compressed gas from a utility pipe through a meter to the steel pipe gas storage facility at a first pressure corresponding substantially to pressure in said utility line, and increasing the pressure of the transferred gas to a second pressure which is greater than said first pressure in said utility line, and (b) wherein the delivering further comprises decompressing the compressed gas from said facility and flowing the decompressed gas to a consumption line.

12. A fuel gas method comprising:

providing a compact on-site end user storage facility to store and supply natural gas for use by end users as their main fuel supply or as their backup fuel supply during periods of interruption from a utility company or other gas provider;

(a) providing a steel pipe gas storage facility by affixing several compatible pieces of steel pipe end to end;

(b) delivering gas to the steel pipe gas storage facility from a utility line through a meter;

(c) controlling the delivering of gas to the steel pipe gas storage facility;

(d) compressing the delivered gas at the steel pipe gas storage facility;

(e) injecting the compressed gas into the steel pipe gas storage facility;

(f) containing the compressed gas within the steel pipe gas storage facility;

(g) releasing the contained gas from the steel pipe gas storage facility;

(h) decompressing the released gas at the steel pipe gas storage facility;

(i) controlling the releasing and the decompressing of the gas; and (j) delivering the decompressed gas from the steel pipe gas storage facility to a consumer line.

* * * * *